United States Patent [19]

Philpot

[11] Patent Number: 5,076,430

[45] Date of Patent: Dec. 31, 1991

[54] BEVERAGE CAN PACK AND METHOD OF MAKING

[76] Inventor: Terry Philpot, 1532 Chemong Road, R.R. 1, Peterborough, Ont., Canada, K9J 6X2

[21] Appl. No.: 597,376

[22] Filed: Oct. 15, 1990

[51] Int. Cl.[5] ..... B65D 21/02; B65B 29/04

[52] U.S. Cl. ..... 206/430; 53/413; 53/447; 206/499; 220/23.83; 414/788.2

[58] Field of Search ..... 206/499, 524.8, 430, 206/432, 427, 497, 515, 519; 220/23.83; 53/413, 447; 414/788.2

[56] References Cited

U.S. PATENT DOCUMENTS

| | | | |
|---|---|---|---|
| 1,975,428 | 10/1934 | John | 206/430 |
| 2,672,981 | 3/1954 | Colgren | 206/499 |
| 2,679,281 | 5/1954 | Penlucci | 206/430 X |
| 2,709,519 | 5/1955 | Cushman | 206/524.8 X |
| 2,988,258 | 6/1961 | Witzke | 206/519 X |
| 3,113,668 | 12/1963 | Taylor | 206/430 |
| 3,565,277 | 2/1971 | Sewitch | 206/499 X |
| 4,183,441 | 1/1980 | Erlandson | 206/430 X |
| 4,932,528 | 6/1990 | Benno | 206/432 |
| 4,940,141 | 7/1990 | Philpot | 206/430 |

FOREIGN PATENT DOCUMENTS

| | | | |
|---|---|---|---|
| WO89/05269 | 6/1989 | PCT Int'l Appl. | 206/524.8 |

*Primary Examiner*—Bryon P. Gehman

*Attorney, Agent, or Firm*—Richard J. Hicks

[57] ABSTRACT

An environmentally friendly beverage pack is described in which beverage cans are stacked in axially aligned groups of three or more. A sealant is adhered around the rim at the bottom of each can before stacking, and each group is then subjected to a vacuum to evacuate the space between the top and bottom of adjacent cans defined by the upper and lower rims around each can. The vacuum holds adjacent cans together and they can be separated by a snapping wrist action for use. If desired, groups may be paired and secured in parallel relationship by hot melt adhesive and handle means may also be provided.

10 Claims, 2 Drawing Sheets

BEVERAGE CAN PACK AND METHOD OF MAKING

FIELD OF INVENTION

This invention relates to a novel package assembly for aluminum or other cans containing beer, soft drinks and other comestibles, and to a method for producing the package.

CROSS REFERENCE TO RELATED CASE

This invention is related to an earlier filed case entitled Shrinkwrap Beverage pack filed Apr. 28, 1989 and now U.S. Pat. No. 4,940,141 issued July 10, 1990.

BACKGROUND OF INVENTION

Numerous packaging methods and devices employing shrink wrap plastic film have been described, including U.S. Pat. Nos. 4,304,332; 3,244,877 and 3,756,395 in addition to the above noted U.S. Pat. No. 4,940,141. In all cases a plurality of cans are held in the pack by means of shrink wrap plastic, with or without handle means to carry the pack.

The use of excessive plastic packaging material is now viewed as environmentally unsound and wasteful and efforts are being made to reduce the use of plastics and other materials used in packaging. The problem remains, however, of securely packing relatively heavy containers such as the standard North American 12 ounce beer can without the use of a great deal of packing material.

OBJECTS OF INVENTION

It is, therefore, one object of the present invention to provide a novel package for aluminum or other cans and the like which eliminates shrink wrap plastic film entirely while providing a secure pack for 6, 12 or even 24 cans. Optionally a plastic handle, generally of film material may be provided.

Another object of this invention is to provide a method for making the novel package of this invention.

BRIEF SUMMARY OF INVENTION

Thus by one aspect of this invention there is provided a package assembly for a plurality of cylindrical articles, such as beverage cans, comprising (a) a plurality of articles arranged end to end in a longitudinally extending and axially aligned group; and (b) gasket means between each of said articles in said group so as to form a sealed space between adjacent longitudinally aligned articles upon which a vacuum is drawn, so that said articles are releasably adhered to each other.

By another aspect of this invention there is provided a method for producing a package assembly comprising a plurality of cylindrical articles such as beverage cans and comprising a plurality of articles arranged end to end in a longitudinally extending and axially aligned group, said method comprising:

applying an elastomeric material around the periphery of at least one longitudinal end of each of said articles;

stacking said articles into said groups; and creating a vacuum in a space between adjacent articles defined by the ends thereof and said elastomeric material and thereby causing adjacent articles to releasably adhere to each other.

BREIF DESCRIPTION OF DRAWINGS

DETAILED DESCRIPTION OF PREFERRED EMBODIMENTS

Figure 1:
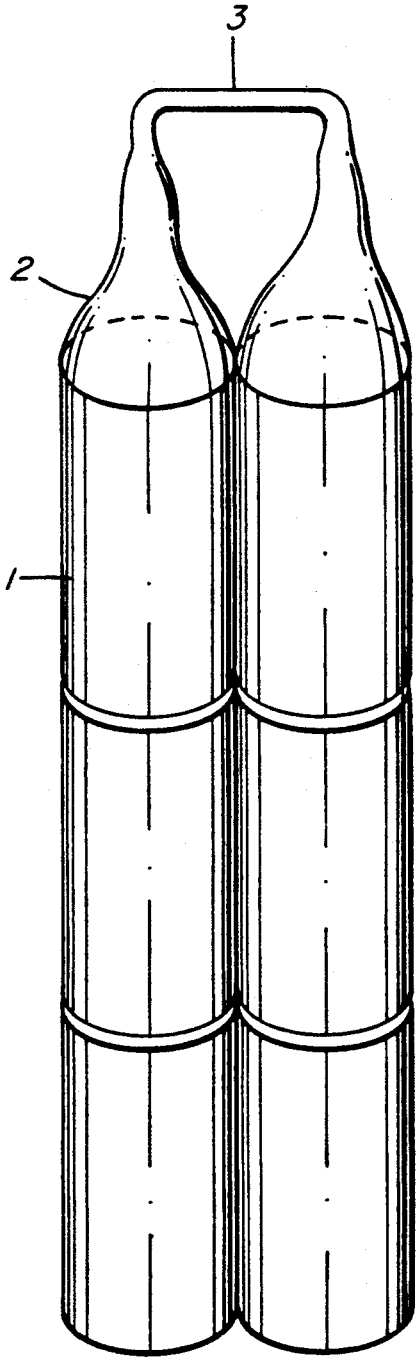
PRIOR ART FIG. 1
FIG. 1 is a front view of a six pack according to my prior patent, with the cans in end to end and side by side relationship.
Figure 2:
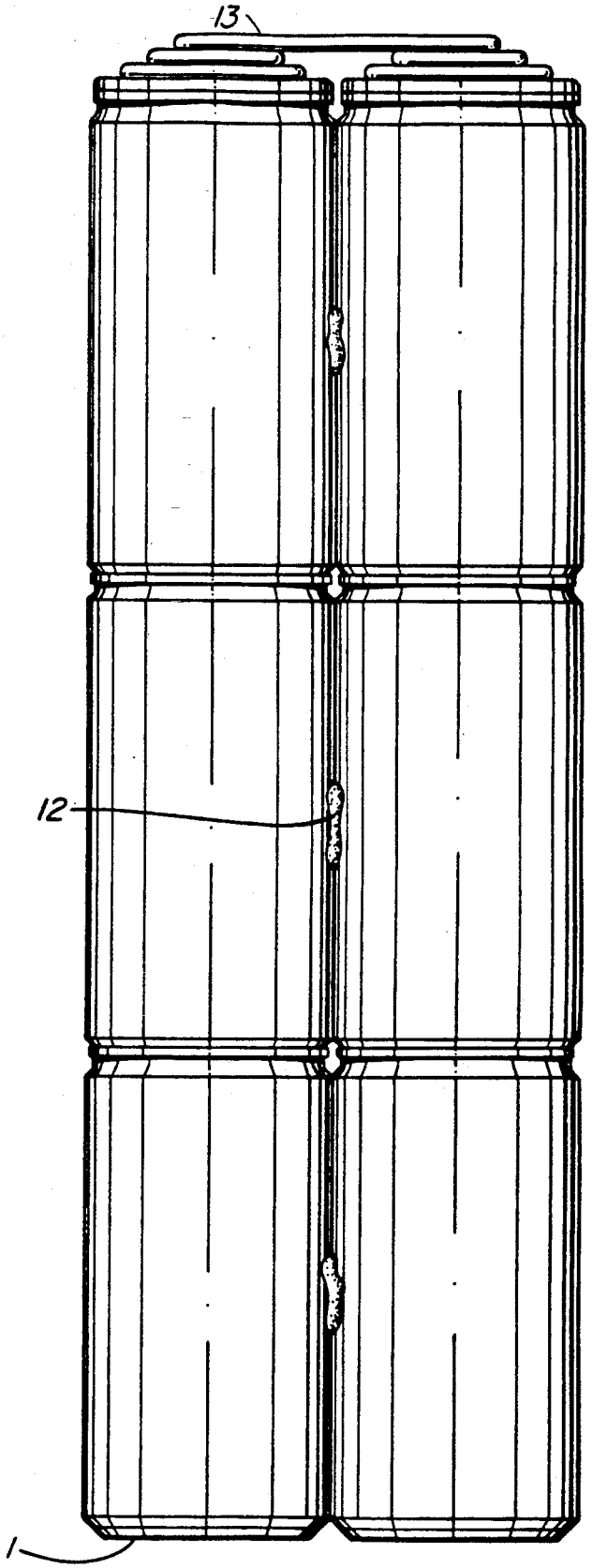
FIG. 2 is a front view of a six pack according to the present invention, showing a hot glue connection between adjacent stacks.
Figure 3:
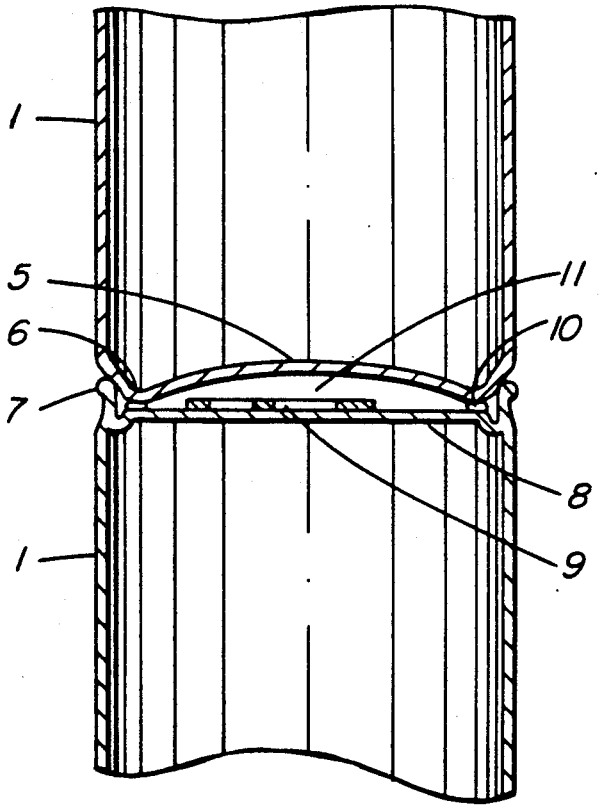
FIG. 3 is a cross sectional view of a portion of FIG. 2 showing the top and bottom of adjacent cans.

In the prior art embodiment shown in FIG. 1 six cylindrical cans 1, containing beer, soft drinks, soups or other comestibles or such products as motor oil are stacked three high in two stacks. The two stacks are contained coaxially within a single longitudinal length of shrink wrap thermoplastic tubing 2 which is shrunk around the cans with a gap between each stack of three which can be used as a handle 3 when the two stacks of three are placed in side by side relationship. This arrangement uses a considerable amount of plastic film and although strips of plastic around the top and base of each pair of cans may be substituted, the automatic machinery used for making such packs is frequently disabled by small pieces or stips of scrap plastic falling into the mechanism. It has now been determined that the shrink wrap plastic strips or tubing may be dispensed with entirely and the cans held in their stacks by vacuum. Aluminum beverage cans are very carefully engineered to provide maximum strength with minimal thickness of material. They are designed to have a substantially disked base 5 (FIG. 3) and a base rim 6 which is somewhat smaller in diameter than the body of the can 1. Similarly there is provided a top rim 7 which is slightly larger in diameter than base rim 6. The top 8 is substantially flat and is provided with a pull tab opening device 9. Thus it will be seen that there is a substantial space 11 between lower disked base 5 and the upper top 8 when two cans are nested together in axial alignment. Lower rim 6 is coated with a polymeric sealing material 10, such as a vinyl coating or a silicone gasket material, so as to provide a resilient seal between rim 6 and top 8. Preferably, coating 10 is allowed to dry before the cans are stacked so as to avoid sticking to the top 8 or top 9 is coated with a release agent so as to ensure a clean top for drinking purposes. The cans are then stacked in axially aligned stacks of selected height, usually 3 high but up to 6 cans are contemplated. The stack is then placed in a vacuum chamber for a short period of time, of the order of 15–30 seconds under a vacuum of about 25–30 inches of mercury, in order to evacuate space 11 between adjacent cans. Alternatively, a steam jet played on the cans and quick condensation is also sufficient to create a vacuum in space 11. The vacuum draws the cans closely together and holds them in axial alignment, as shown more clearly in FIG. 2. For convenience two stacks of 3 are held in parallel alignment by a small amount of a hot melt or other adhesive 12 at suitable intervals along the axial length. If desired, a handle 13 may be secured in conventional manner at the top of each stack, for ease of carrying. The handle 13 may be a plastic strip or other material and may even be a folded garbage bag for containing the empty cans after use.

In order to separate the cans for use it is merely necessary to tear the adhesive 12 to separate the two stacks and then snap two cans apart with a sharp wrist movement in order to release the vacuum in space 11.

After consumption of the can's contents the aluminum can may be disposed of in the usual way for recycling. No plastic or ther packaging material contaminates the aluminum or presents a separate disposal hazard or problem. This packaging method is, therefore, the ultimate in environmental protection.

While this invention has been described with reference to aluminum cans, it will be appreciated that it is equally applicable to plastic and plastic/aluminum cans such as those commonly used in Europe and Japan.

I claim:

1. A package assembly for a plurality of beverage cans, comprising:

(a) a plurality of cans arranged end to end in a longitudinally extending and axially aligned group; and (b) gasket means between each of said cans in said group so as to form a sealed space between adjacent longitudinally aligned cans upon which a vacuum is drawn, so that adjacent said cans are releasably adhered to each other.

2. A package assembly as claimed in claim 1 comprising a pair of groups arranged with their longitudinal axes being substantially parallel to each other.

3. A package assembly as claimed in claim 2 wherein said cans are deep-drawn aluminum cans which are nestable end to end.

4. A package assembly as claimed in claim 3 comprising a pair of groups and including handle means interconnecting said pair of groups at one end thereof and secured to a respective can in each group.

5. A package assembly as claimed in claim 4 including means to hold a pair of groups in side-by-side relationship.

6. A package assembly as claimed in claim 5 wherein said means to hold said groups is a hot-melt adhesive.

7. A method for producing a package assembly comprising a plurality of beverage cans comprising a plurality of beverage cans arranged end to end in a longitudinally extending and axially aligned group, said method comprising:

applying an elastomeric material around the periphery of at least one longitudinal end of each of said cans;

stacking said cans into said group; and creating a vacuum in each space between adjacent cans defined by the adjacent longitudinal ends thereof and said elastomeric material and thereby causing adjacent cans to releasably adhere to each other.

8. A method as claimed in claim 7 wherein said elastomeric material is selected from a vinyl material and a silicone sealant material.

9. A method as claimed in claim 8 wherein said group is subjected to a vacuum chamber so as to create a vacuum in each said space.

10. A method as claimed in claim 8 wherein said group is sprayed with steam and rapidly cooled so as to create a vacuum in each said space.

* * * * *